United States Patent [19]

Gentile

[11] 4,363,560

[45] Dec. 14, 1982

[54] PROPEL-REPEL SOLID STICK DISPENSER

[76] Inventor: Charles J. Gentile, 8 Winding Way, North Caldwell, N.J. 07006

[21] Appl. No.: 835,906

[22] Filed: Oct. 26, 1977

[51] Int. Cl.[3] ..... B67D 3/00

[52] U.S. Cl. ..... 401/68; 401/175

[58] Field of Search ..... 401/68, 116, 171, 172, 401/175, 149, 150, 202

[56] References Cited

U.S. PATENT DOCUMENTS

| | | | |
|---|---|---|---|
| 416,659 | 12/1889 | Wells et al. | 401/172 |
| 1,783,754 | 12/1930 | Stepelton | 401/175 |
| 2,101,132 | 12/1937 | Daly et al. | 401/175 |
| 2,917,765 | 12/1959 | Jakubowski | 401/175 |
| 3,008,172 | 11/1961 | Thompson | 401/149 |
| 3,212,120 | 10/1965 | Gentile | 401/175 |
| 3,235,900 | 2/1966 | Klassen | 401/175 |
| 3,264,676 | 8/1966 | Schwartzman | 401/202 |
| 3,281,887 | 11/1966 | Raffe | 401/202 |
| 3,616,970 | 11/1971 | Baumann et al. | 401/175 |

*Primary Examiner*—William Pieprz

*Attorney, Agent, or Firm*—John N. Bain; Louis E. Marn; Paul H. Kochanski

[57] ABSTRACT

A propel-repel solid stick dispenser for deodorants, anti-perspirants and other cosmetics, medicaments or the like in which the external container is closed, preferably by use of an integral, one-piece body, except for the opening for application, which opening may be sealed by means of a detachable cap thereby securing the dispensable material against air deterioration or evaporation and including means for advancing and retracting the stick of dispensable material by one-handed fingertip rotational manipulation by the hand holding the dispenser.

10 Claims, 10 Drawing Figures

PROPEL-REPEL SOLID STICK DISPENSER

BACKGROUND OF THE INVENTION

Stick dispensers for deodorants, anti-perspirants, medicaments, cosmetics and the like are well-known in the art. One of the most common dispensers includes a generally cylindrical container, open at both the top and the bottom. The top is provided with a detachable cap. A piston is slidably seated within the container, the bottom of the piston being accessible to finger pressure through the open bottom. The stick of dispensable material may be advanced by forcing the piston upwardly toward the top. However, in such a structure it is difficult to force the stick of material downwardly particularly if it is relatively soft.

In order to provide for both advancement and retraction of the stick of dispensable material, a similar container is well-known in the art including a threaded transport shaft which extends along the longitudinal axis of the container. The piston is threadably engaged to the shaft and provided with means to secure it against rotation within the container. A knob is attached to the bottom of the shaft at the bottom of the container. Rotation of the knob induces translational movement on the part of the piston which forces the stick material either upwardly or retracts it downwardly. Such dispensers are commonly known as propel-repel type.

One of the most difficult problems encountered in stick dispensers is the exclusion of air and the prevention of evaporation over a long period of time. Deodorants, antiperspirants and other cosmetics as well as the solid carrier media are subject to air deterioration and evaporation. It is economically impractical to encase dispensers in air-sealed packages. Moreover, if such a package were employed, once the consumer opens the package, air deterioration and evaporation commences.

The fewer the openings in the dispenser, the less the opportunity for air penetration or evaporation of material contained there within which is equally as detrimental if not more so. Dispensers with a manually pushed piston must provide a relatively large opening in the bottom for access to the piston. Both evaporation and air penetration are very substantial. Propel-repel dispensers which include turning knobs at the bottom must necessarily include an opening for mechanical connection of the turning knob with the threaded shaft. Here again evaporation and air penetration is substantial.

Nevertheless, the propel-repel type dispenser is superior to the manually operated push type dispenser because the solid stick can be retracted after use. Additionally, it is desirable to provide a propel-repel type dispenser which can be manipulated by one hand rather than requiring the body of the dispenser to be held by one hand and a turning knob manipulated by the other hand. The one-hand type of manipulation permits advancement of the stick as it is being used if necessary.

Therefore, it is among the objects and advantages of the present invention to provide a propel-repel solid stick dispenser for deodorants, anti-perspirants, medicaments, cosmetics or the like which is secure against deterioration of the dispensable material by virtue of either evaporation from the dispenser or air penetration into the dispenser.

Another object of the present invention is to provide a propel-repel solid stick dispenser of the character aforesaid which can be manipulated to advance or retract the stick by one hand, that spporting the dispenser.

Yet another object of the present invention is to provide a propel-repel solid stick dispenser of the character aforesaid having a cap closure which seals against both evaporation and air penetration without relying upon a seal generated by the inter-engagement of threads on the body of the dispenser and the cap.

Yet still another object of the present invention is to provide a propel-repel solid stick dispenser of the character aforesaid which may be fabricated of inexpensive molded plastic and which may be quickly and easily assembled thereby providing both a functionally superior and inexpensive dispenser.

These objects and advantages as well as other objects and advantages may be achieved by the dispenser claimed herein a preferred embodiment of which is illustrated in the drawings.

PREFERRED EMBODIMENT

A preferred embodiment of the dispenser claimed herein is illustrated in the drawings in which:

Figure 1:
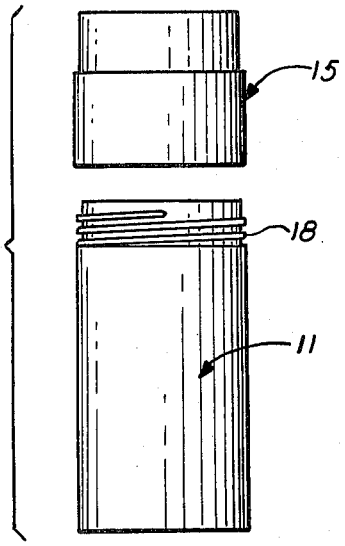
FIG. 1 is a side elevational view of an external container with the closure cap removed and shown spaced away from the top thereof.
Figure 2:
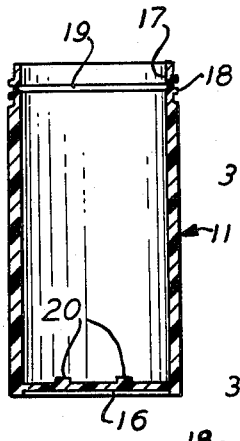
FIG. 2 is a side elevational cross-sectional view of the external container shown in FIG. 1.
Figure 3:
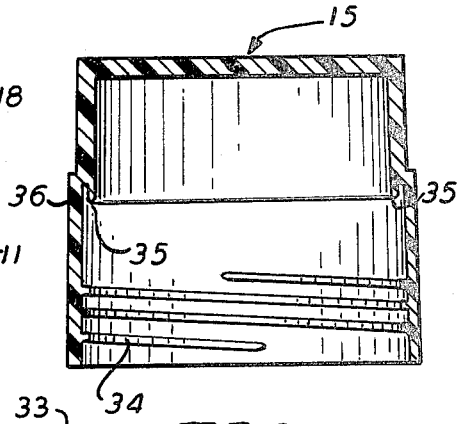
FIG. 3 is a side elevational cross-sectional view of the closure cap shown in FIG. 1.
Figure 10:
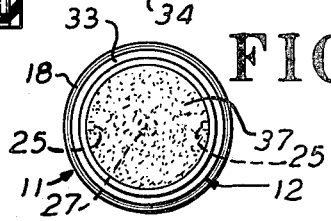
FIG. 10 is a top plan view of the assembly shown in FIG. 9 with the cap removed.
Figure 4:
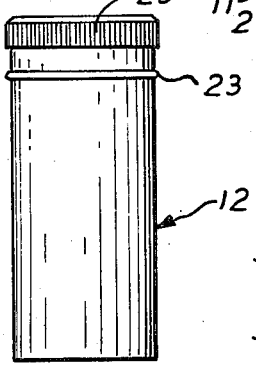
FIG. 4 is a side elevational view of an internal cartridge.
Figure 6:
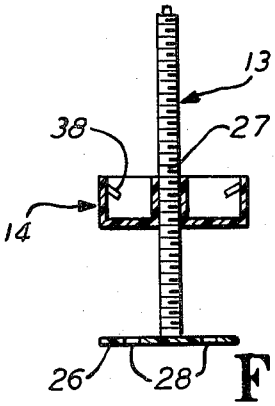
FIG. 6 is a side elevational view of a threaded transport shaft assembly.
Figure 9:
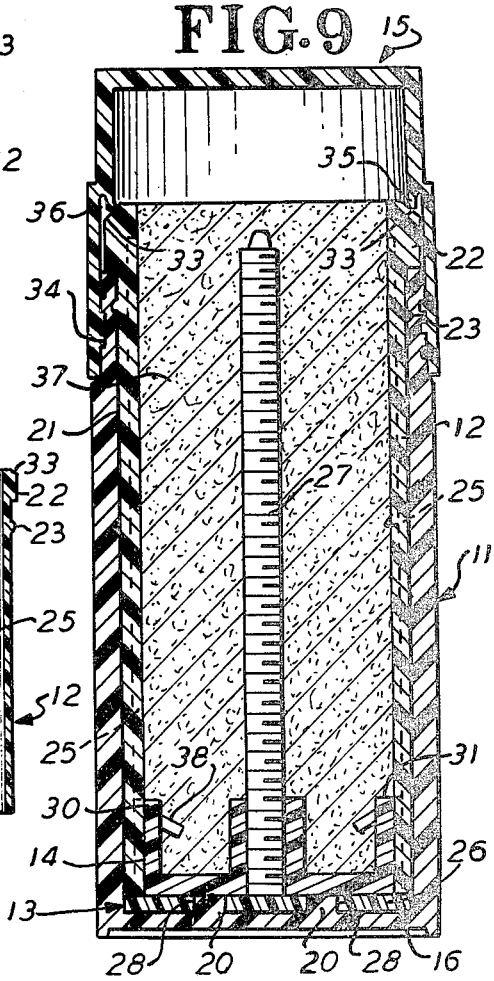
FIG. 9 is a side elevational cross-sectional view of the assembled dispenser showing the external container, internal cartridge, the threaded transport assembly with piston mounted thereon and the cap secured in sealing arrangement.
Figure 5:
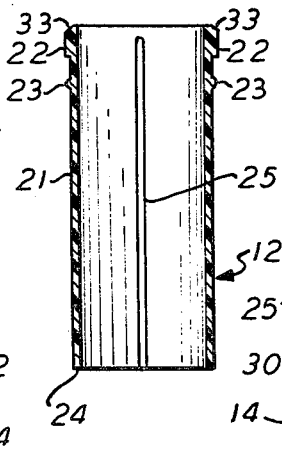
FIG. 5 is a side elevational cross-sectional view of the cartridge shown in FIG. 4.
Figure 7:
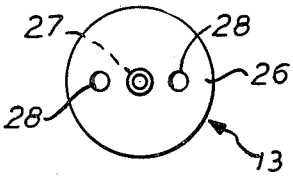
FIG. 7 is a top plan view of the threaded transport shaft assembly shown in FIG. 6.
Figure 8:
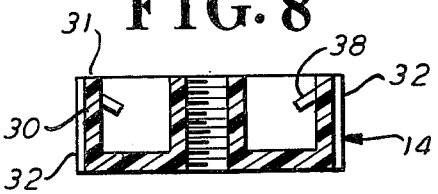
FIG. 8 is a side elevational cross-sectional view of a piston threadably engagable with the transport shaft.

Referring now to the drawings in detail the preferred embodiment of propel-repel solid stick dispenser claimed herein comprises an external, generally cylindrical container 11, an internal, generally cylindrical cartridge 12 which may be slidably seated within the container 11, a threaded transport assembly 13 positioned within the container 11, a piston 14 threadably mounted upon the shaft assembly 13 and a closure cap 15 which is detachably and threadably engagable to the external container 11 and which is provided with internal sealing means for engagement with the top of the internal cartridge 12.

The external container 11 is closed at the bottom 16, open at its top 17 and preferably formed from one molded plastic piece thereby obviating the necessity of closing and sealing openings other than at the top 17. Nevertheless, the container 11 may be fabricated of two pieces, a hollow cylinder and a bottom cap permanently secured thereto by heat, thermosetting adhesive, ultrasound or the like which results in an air-tight seal. In the claims, the phrase: "the bottom of the container is positively sealed against air passage" means either a one piece construction or a two piece construction with the aforesaid type of sealed joint. The outside diameter of the container 11 is radially reduced proximal to the top 17 and provided with molded external helical threads 18. An internal retainer rib 19 is formed on the container 11 proximal to the open top 17. Additionally, the bottom 16 of the container 11 is provided with a pair of opposed, spaced apart position retaining posts 20—20 which are inter-engagable with the threaded shaft assembly as will be described in greater detail hereafter.

The internal, generally cylindrical cartridge 12 is dimensioned to slidably pass downwardly through the open top 17 of the container 11, the outside diameter of the cartridge 12 being incrimentally smaller than the inside diameter of the container 11. The wall 21 of the cartridge 12 is provided with a radially enlarged top portion 22. An external, annular, radially enlarged retaining rib 23 is formed on the wall 21 beneath the radially enlarged top portion 22.

The wall 21 of the cartridge 11 is dimensioned axially from the bottom of the radially enlarge portion 22 to the bottom 24 slightly shorter than the depth of the container 11 from the top 17 to the bottom 16. The cartridge 11 is also provided with a pair of diametrically opposed axially extending internally raised rails 25 extending from slightly beneath the top to the bottom. The cartridge 12 is open at both its top and bottom.

The threaded transport assembly 13 comprises a base disc 26 having formed thereon and extending perpendicularly thereto a threaded transport shaft 27. The disc 26 is provided with a pair of diametrically opposed spaced apart passages 28—28. The diameter of the disc 26 is incrimentally smaller than the internal diameter of the external container 11.

The dispenser is assembled by inserting the threaded shaft assembly 13 into the container 11 through the open top 17 passing it downwardly until the posts 20, 20 pass through passages 28—28 in the disc 26. The disc 26 will then lay against the bottom 16 of the container 11 and the posts 20,20 secure the assembly against rotation with respect to the container 11. The threaded transport shaft 27 is dimensioned somewhat shorter than the distance between the top 17 and bottom 16 of the container 11.

The internal cartridge 12 is then passed downwardly through the open top 17 of the container 11 until the bottom 24 thereof rests against the disc 26. The external rib 23 on the cartridge 12 snaps over the internal rib 19 on the container 11 as the cartridge passes downwardly. When the cartridge 12 is in position, the rib 19 lies generally snugly against the rib 23 thereby retaining the cartridge 12 against axial movement with respect to the container 11. The radially enlarged portion 22 of the cartridge 12 lies above the top 17 of the container 11. Preferably, the radially enlarged portion 22 of the cartridge 12 is provided with axially extending serrations or grooves 29 to provide a gripping surface.

Preferably, the piston 14 has been threadably mounted on the threaded transport shaft 27 immediately proximal to the disc 26 prior to assembly of the shaft 13 with the container 11. The piston 14 has a generally cylindrical external wall 30 and a top 31. The wall 30 is provided with a pair of axially aligned, opposed grooves 32,32. During assembly, the grooves 32,32 in the wall 30 of the piston 14 receive the respective internal rails 25, 25 on the cartridge 12. Thus, the piston 14 is coupled to the internal cartridge 12 for rotation therewith.

While the diameter of the disc 26 has been described as being incrimentally smaller than the internal diameter of the container 11, obviously, the cartridge 12 may be dimensioned to pass downwardly to the bottom 16 of the container 11 with the diameter of the disc 26 being incrimentally smaller than the internal diameter of the cartridge 12. This variation is optional.

After the major elements have been assembled, and with the piston 14 in the lower most position, the dispensable material is introduced into the cartridge 12 by well-known techniques.

The radially enlarged portion 22 of the internal cartridge 12 is provided with an external, annular chamferred surface 33 at its top. The chamferred surface 33 is adapted to engage internal sealing means within the cap 15. The cap 15 is provided with internal threads 34 which are engagable with the external threads 18 proximal to the top 17 of the external container 11. The cap 15 is also provided with an external, depending, annular flange 35 which is spaced away from the side wall 36 of the cap 34. The flange 35 is engagable with the chamferred surface 33 at the top of the internal cartridge 12.

The flange 35 is deformable sufficiently to form a tight gas-proof seal with the chamferred surface 33 as the cap is threadably screwed downwardly onto the external container 11. Of course, this in turn forces the internal cartridge to seat tightly against the bottom 16 of the container 11 which, together with the close fit between the wall 21 of the cartridge 12 and the internal surface of the container 11 provides assurance against air deterioration or evaporation of the dispensable material contained within the cartridge 12.

In operation, the cap 15 is threadably detached from the container 11. In order to propel or advance the dispensable material 37 toward the open top of the internal cartridge 12, the cartridge 12 is rotated with respect to the container 11 by finger manipulation of the radial enlargement 22. Rotation of the cartridge 12 induces rotation of the piston 14 by virtue of coupling with the rails 25,25.

However, the threaded transport shaft assembly 13 is keyed to the container 11. Hence relative rotational movement between the cartridge 12 and container 11 generates relative rotational movement between the threaded transport shaft 27 and the piston 14 which is threadably engaged thereto. Thus, the piston 14 will either advance or withdraw along the threaded transport shaft 27 depending upon the direction of relative rotation between the cartridge 12 and container 11.

The piston 14 may be provided with members 38 which are molded into the dispensable material 37 and thereby will cause the dispensable material to withdraw into the cartridge 12 as the piston 14 moves along the threaded transport shaft 27 towards the bottom 16 of the container 11.

The entire dispenser may be manipulated by one hand, the thumb and forefinger rotating the radial enlargement 22 on the internal cartridge 12 while the remainder of the fingers and palm of the hand source the external container 11 against rotation. Thus, the dispensable material may be advanced as it is being dispensed without resort to the use of two hands or withdrawing the dispenser from the body.

When not in use, the dispensable material 37 may be withdrawn to the level of the top of the cartridge 12. The cap 15 is then threadably attached to the container 11 until its internal flange 35 tightly engages the entire chamferred surface 33 thereby providing the requisite seal against evaporation or air intrusion.

As will be understood by those skilled in the art many modifications and variations of subject invention may be made without departing from the spirit and scope thereof.

What is claimed is:

1. A propel-repel solid-stick dispenser comprising:

(a) an external container open at one end and closed at the opposite end;

(b) a threaded transport shaft mounted in the container for rotation therewith;

(c) a cartridge mounted within the container, the cartridge being open at the end most proximal to the open end of the container and rotatable independently of the container and the shaft;

(d) a piston threadably mounted on the shaft, the piston being translationally moveable along the shaft in response to relative rotational movement between the piston and the shaft;

(e) means for rotating the piston in response to rotation of the cartridge;

(f) means for generating relative rotational movement between the container and the cartridge, whereby the open end of the cartridge extends beyond the open end of the container thereby providing said means for simultaneously generating relative rotational movement between the container and the cartridge and between the piston and the shaft;

(g) closure means detachably engaged at the open end of the container;

(h) a bearing surface at the top of the cartridge tapering inwardly toward the open end thereof, and (i) a continuous resiliently outwardly expandable rib in the closure means engageable with the bearing surface at the open end of the cartridge.

2. A propel-repel solid-stick dispenser in accordnce with claim 1, and (a) a radially outwardly enlarged portion at the top of the cartridge defining an offset, the cartridge being dimensioned from top to bottom so that the offset tightly engages the top of the container when the rib in the closure means is engaged to the bearing surface at the top of the cartridge.

3. A propel-repel solid-stick dispenser in accordance with claim 2, (a) a base on the threaded transport shaft, (b) means for coupling the said base to the closed end of the container so that the shaft rotates with the container.

4. A propel-repel solid-stick dispenser in accordance with claim 3, in which (a) the means for coupling the base to the closed end of the container are pins extending from one into the other.

5. A propel-repel solid-stick dispenser in accordance with claim 4 in which (a) the said base is engagable with the container so as to permit the shaft to extend only along the longitudinal axis of the container when the base lies flat against the closed end thereof.

6. A propel-repel solid stick dispenser in accordance with claim 3 and (a) a base on the bottom of the threaded transport shaft extending transversely across the container at its bottom to position the transport shaft coincident with the longitudinal axis of the container and cartridge.

7. A propel-repel solid stick dispenser in accordance with claim 6 and (a) a flat bottom on the said base, (b) a flat bottom on the container, and (c) pin means coupling the base and the bottom of the container for mutual rotation.

8. A propel-repel solid stick dispenser in accordance with claim 7 in which (a) the said base has a peripheral plan configuration conforming to the internal cross-sectional configuration of the container and is dimensioned to closely conform thereto.

9. A propel-repel solid-stick dispenser in accordance with claim 2 in which (a) the cartridge is entirely open at both top and bottom defining a substantially unobstructed passage.

10. A propel-repel solid-stick dispenser in accordance with claim 2 in which (a) the bottom of the container is positively sealed against air passage.

* * * * *